US008231185B1

(12) United States Patent
Trusty

(10) Patent No.: US 8,231,185 B1
(45) Date of Patent: Jul. 31, 2012

(54) PORTABLE VIDEO PODIUM, PRESENTATION CASE, AND DUAL STORAGE BOXES

(76) Inventor: Jon Trusty, Santa Clarita, CA (US)

( * ) Notice: Subject to any disclaimer, the term of this patent is extended or adjusted under 35 U.S.C. 154(b) by 751 days.

(21) Appl. No.: 12/335,779

(22) Filed: Dec. 16, 2008

(51) Int. Cl.
*E04H 1/12* (2006.01)
*E04H 1/14* (2006.01)

(52) U.S. Cl. ..... 312/6; 312/108; 312/265.1; 312/223.1

(58) Field of Classification Search ..... 312/4–6, 312/3, 108, 33, 140.2, 265.1–265.4, 283, 312/290, 249.8, 249.12, 297, 321.5, 244, 312/317.3, 10.1, 223.1; 108/143; 353/72, 353/74; 211/26.2, 194, 180
See application file for complete search history.

(56) References Cited

U.S. PATENT DOCUMENTS

| | | | | | |
|---|---|---|---|---|---|
| 630,685 | A | * | 8/1899 | Grace | 206/278.1 |
| 1,700,924 | A | * | 2/1929 | Cushman | 312/277 |
| 2,517,757 | A | * | 8/1950 | Adlerstein | 312/3 |
| 2,962,334 | A | * | 11/1960 | Dutmers | 312/108 |
| 3,424,178 | A | * | 1/1969 | Yazaki | 135/157 |
| 3,834,549 | A | * | 9/1974 | Burg et al. | 211/189 |
| 4,400,043 | A | * | 8/1983 | Rossow | 312/111 |
| 4,550,956 | A | * | 11/1985 | Cohn et al. | 312/209 |
| 4,634,193 | A | * | 1/1987 | Liu | 312/107 |
| 4,741,167 | A | * | 5/1988 | Wigley | 62/62 |
| 4,784,382 | A | | 11/1988 | Myers | |
| 4,844,566 | A | | 7/1989 | Moore et al. | |
| 5,028,099 | A | * | 7/1991 | Bertucco | 312/249.12 |
| 5,044,595 | A | * | 9/1991 | Carr et al. | 248/460 |
| 5,382,087 | A | | 1/1995 | Pouch | |
| 5,680,744 | A | * | 10/1997 | Kramedjian et al. | 53/447 |
| 5,845,978 | A | * | 12/1998 | Jung | 312/244 |
| 6,102,219 | A | * | 8/2000 | Wang | 211/194 |
| 6,116,438 | A | * | 9/2000 | Lovett | 211/194 |
| 6,142,324 | A | * | 11/2000 | Huang | 211/188 |
| 6,142,589 | A | * | 11/2000 | Wang | 312/6 |
| 6,152,547 | A | * | 11/2000 | Wang | 312/3 |
| 6,189,700 | B1 | | 2/2001 | Packrall et al. | |
| 6,378,968 | B1 | | 4/2002 | Weng | |
| 6,601,928 | B1 | * | 8/2003 | Kortman et al. | 312/3 |
| 2002/0078865 | A1 | * | 6/2002 | Kuvshinikov | 108/143 |
| 2003/0123032 | A1 | * | 7/2003 | Rodriguez, Jr. | 353/74 |
| 2005/0001521 | A1 | * | 1/2005 | Illingworth McKinnon | 312/265.3 |
| 2005/0057803 | A1 | * | 3/2005 | Cruz-Uribe et al. | 359/443 |
| 2006/0125360 | A1 | * | 6/2006 | Kim et al. | 312/405.1 |
| 2007/0126317 | A1 | * | 6/2007 | Liu | 312/6 |
| 2007/0227994 | A1 | * | 10/2007 | Cho | 211/188 |
| 2009/0045015 | A1 | * | 2/2009 | Anstead et al. | 187/244 |

* cited by examiner

*Primary Examiner* — Darnell Jayne
*Assistant Examiner* — Andres F Gallego

(57) ABSTRACT

A multi-purpose assembly capable of being used for many activities. In a first embodiment, a portable podium is formed from two lightweight frame boxes which quickly disconnect and disassemble completely. The first embodiment secures a flat screen video display unit to a front side of the podium to allow a presenter to present a video and audio presentation while standing behind the podium. In a second embodiment, a presentation is provided when the podium device is viewed from a back side and doors on that side are opened and secured to vertical right and left side walls. Multiple, removable support containers are arranged on the exposed interior of the presentation case and upon the exposed inside surfaces of the doors. Lights and sound can accompany presentation of goods or entertainment acts.

5 Claims, 12 Drawing Sheets

PORTABLE VIDEO PODIUM, PRESENTATION CASE, AND DUAL STORAGE BOXES

FIELD OF THE INVENTION

The present invention relates to portable podiums, particularly those which are capable of complete disassembly and reassembly.

BACKGROUND OF THE INVENTION

Conventional podiums are not generally transportable or storable because of their cumbersome size and weight. While the need for a readily transportable and storable podium has been recognized for many years, attempts to provide such a podium have generally resulted in a podium which is exceedingly difficult to assemble/disassemble, structurally defective and/or excessively heavy.

U.S. Pat. No. 5,044,595 discloses a podium which is capable of disassembly, being formed of multiple curved and vertical sections joined together at horizontal plates. The disassembled podium still requires substantial storage space for the curved sections.

U.S. Pat. No. 6,189,700 discloses a storage and transport case formed in a single piece capable of being used as a podium. It cannot be disassembled into smaller units.

U.S. Pat. No. 5,832,087 discloses a podium formed from a top and bottom plate with a set of four hinged vertical sections separating them. This device can be disassembled and stored compactly but has no function outside of providing a small presentation platform.

U.S. Pat. No. 4,844,566 discloses a set of four cubes stacked together to form a presentation platform.

U.S. Pat. No. 4,784,382 discloses a child's play desk with drawers and sections of a top surface which slide to form right and left side support surfaces.

A need still exists for a lightweight, structurally stable, readily transportable and storable podium which is simple to assemble and disassemble and which is capable of being completely disassembled. In addition, a podium is a single use device incapable of alternate functions while not used for public presentations. It generally comprises a top surface supported above one or more cavities facing the presenter. There is a need for an alternate function for the prior art podium. Further, when not in use, the structure and rigid enclosure of the cavities of the typical podium are generally unavailable as storage space because of the need to instantly move a podium from a storage location to a presentation location. There is a need for means by which such storage space within the typical podium can be effectively used when the podium is not in use.

SUMMARY OF THE INVENTION

The present invention is a multi-purpose assembly capable of being used for many activities. In a first embodiment, the present invention is a portable podium formed from two lightweight frame boxes which quickly disconnect and disassemble completely. The first embodiment comprises means for securing a flat screen video display unit to a front side of the podium to allow a presenter to present a video and audio presentation while standing behind the podium. In a second embodiment, the present invention is a presentation case when the podium device is viewed from a back side and doors on that side are opened and secured to vertical right and left side walls. Multiple, removable support containers are arranged on the exposed interior of the presentation case and upon the exposed inside surfaces of the doors. Lights and sound can accompany presentation of goods or entertainment acts.

In the first embodiment, the invention further comprises means for securing a main cavity within the two frame boxes, whereby a user can easily pick up said boxes by way of top side handles and transport materials within the boxes weighing up to 75 pounds or more. In the first embodiment, the portable podium can separated into two storage boxes which a user can easily carry. If a user wishes, a fabric covering of the frames of the boxes can be quickly removed by disconnecting opposing hook and loop strips, whereafter said frames slide easily apart. Upon disassembly, a user must primarily only store a set of straight frame pieces, folded fabric covering, and floor plates.

A fabric covering for the boxes of the first embodiment is preferred. Rigid and lightweight plastic, carbon fiber or metal plates can alternately be fixed upon the top, bottom and side walls of the lightweight frames to form a rigid walled box and rear side doors according to the invention. Fabric covering is preferred for its lightweight and for its ease in being secured with substantial tension over the frame by way of opposing hook and loop strips located on fabric extensions from main side wall pieces. However, other securing means are within the objects of the invention, such as snaps, latches, zippers, and the like.

Another form of the first and second embodiments is to provide horizontal sliding panels that extend in right and left directions from a top surface of the podium or presentation case to provide additional support surface for a presenter. In that way, a presenter can choose to locate on those sliding panels such things as folders, a laptop computer, a digital projector and the like. The cavities provided by the two boxes forming the podium or presentation case are sufficient for securing a power source such as a battery for powering devices such as lights, laptop computers, and digital projectors, as well as a flat screen video display screen optionally located at the front side of the podium. The sliding means for the sliding panels are formed of a stationary piece fixed to a top side of the box frame and a movable piece. The movable piece comprises a hook and loop strip which matches to a hook and loop strip on the underside of the sliding panel so that the sliding panel can be easily removed for disassembly.

Consistent with complete disassembly of the two box construction of the podium, each box comprises a floor plate, formed from a single piece or two or more pieces, which is removable from secure connection with the frame of the box. Hook and loop strips on the top side of the lower rectangle of the frame of the sliding panel match to opposing hook and loop strips on underside edges of a floor plate so that the floor plate can be easily disengaged from the frame of the box.

A further embodiment of the invention is to provide portable storage for a user with a podium or presentation case. A lower one of two boxes is provided with casters or small wheels, whereby a user simply tilts the entire podium in any direction, grasps one of the topside handles or hand grips, and pulls the device as a user would a wheeled piece of luggage.

One object of the invention is to provide a dual box structure for a portable podium, whereby a top box is capable of being secured and easily disengaged from a lower box.

Another object of the invention is to provide a podium and a multi-level presentation box in the same device, where a front view of the device appears to a viewer to be a podium and a rear view of the device appears to a viewer to be a multi-level presentation box.

Yet another object of the invention is to provide a portable podium comprising two stackable frame boxes which are capable of being disassembled.

DETAILED DESCRIPTION OF THE INVENTION

The invention is now discussed with reference to the figures.

Figure 1:
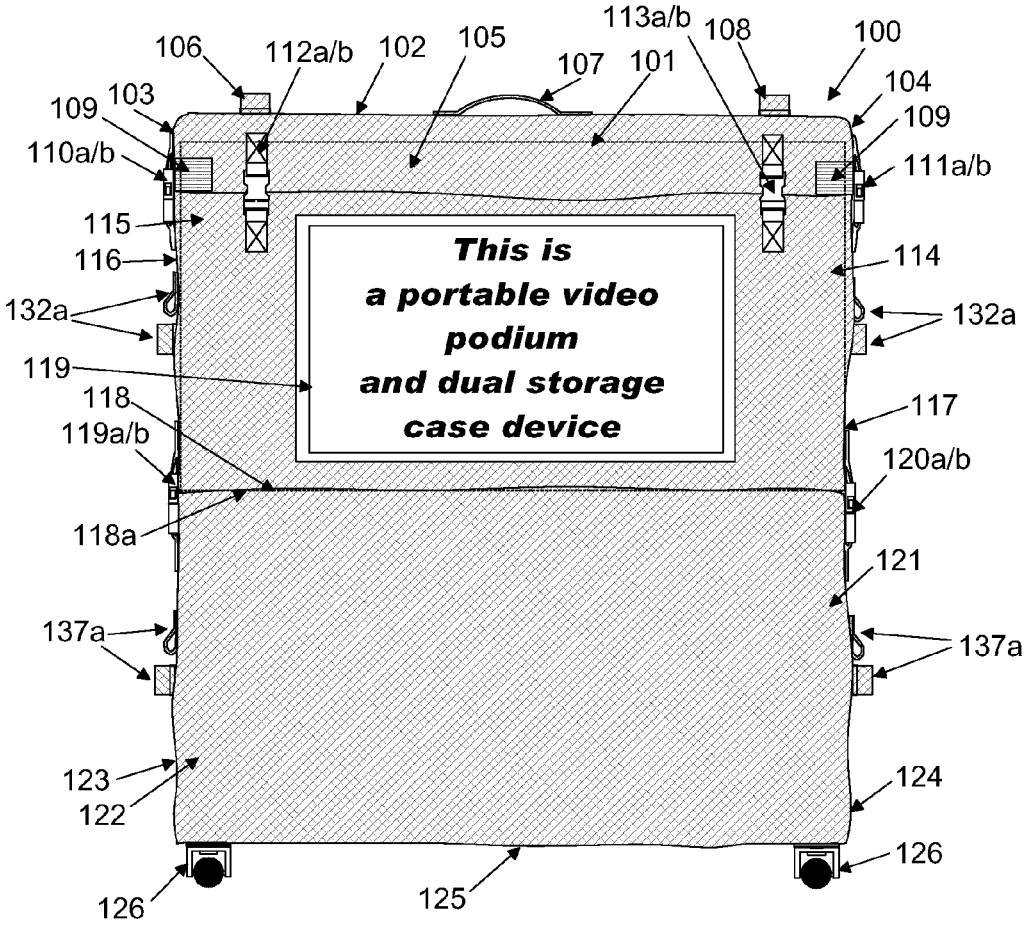
FIGS. 1 and 2 are respectively front and side views of the multi-purpose invention device.
Figure 2:
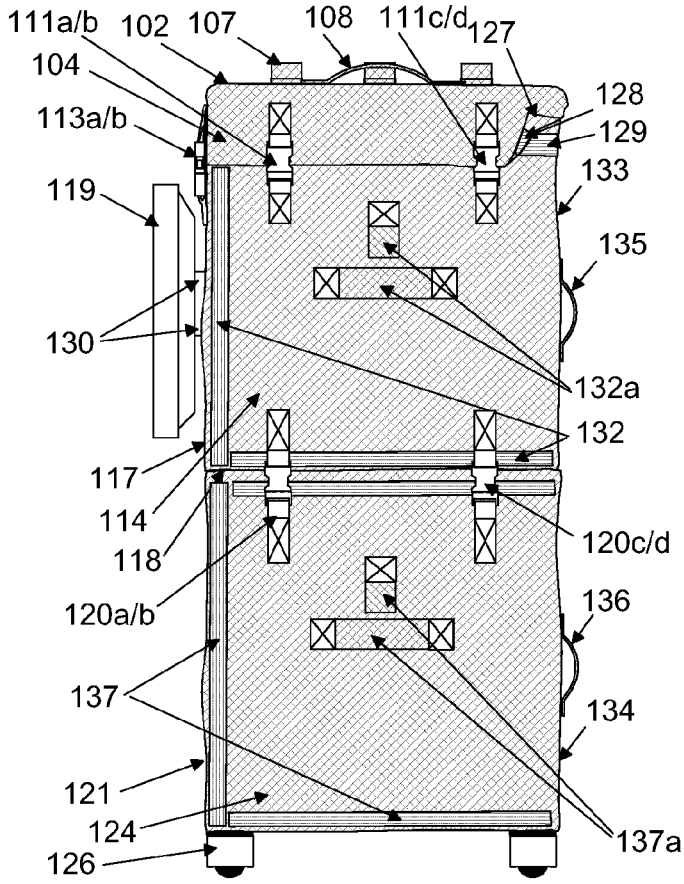

FIGS. 1 and 2 are respectively front and side views of the invention multi-purpose device 100. FIG. 1 shows a top carrying cover 101 is releasably joined to a top box 114 by way of latches 110*a/b*, 112*a/b*, 113*a/b*, and 111*a/b*. The top box 114 is releasably joined to lower box 121 by way of latches 119*a/b* and 120*a/b*. At a bottom 125 of lower box 121 are fixed four casters or wheels 126 so that the entire device can be easily rolled across a floor or tilted and pulled in any direction using handles 106, 107 and 108 on top carrying cover 101. Top carrying cover 101 comprises a top 102 upon which are fixed handles 106-108. Descending from top 102 are sides 103, 104, 105 and 147 (shown in FIG. 4 at the rear of the device). Referring again to FIG. 1, top carrying cover 101 is preferably formed of a heavy dernier fabric such as nylon or cotton to withstand handling typical of portable podiums and storage cases. Cover 101 defines a downward concavity covering a presentation surface upon which a user can rest documents or other materials used in a presentation. Cover 101 is intended to be easily removable but capable of supporting from the hand of a user the entire weight of top box 114 with up to or over 75 pounds of materials inside by way of the handles 106-108.

Figure 3:
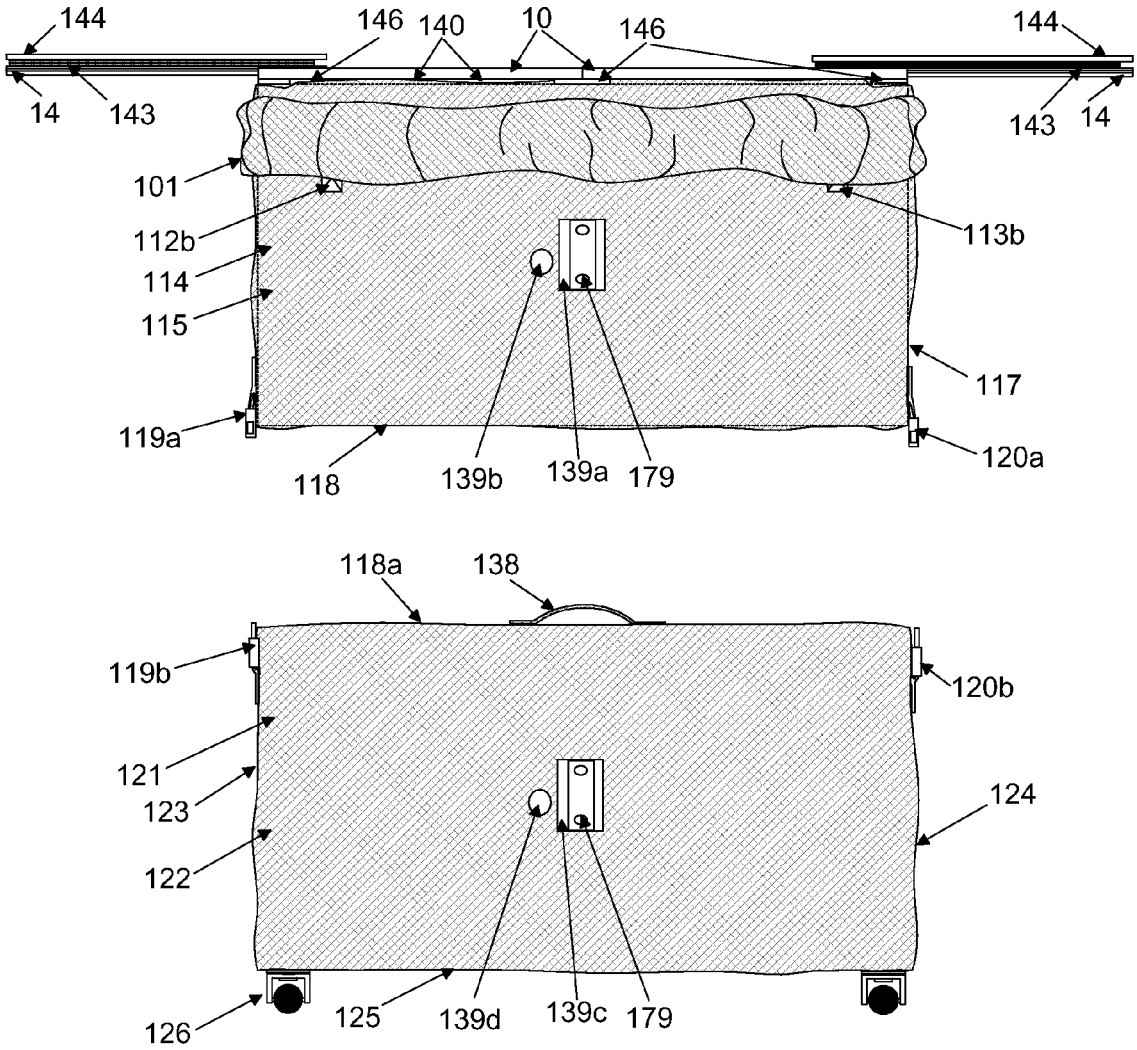
FIG. 3 is a front view of the device of FIG. 1 with a top carrying cover rolled forward and secured in place by opposing hook and loop strips, top and bottom boxes separated for individual carrying, and a flat screen video display panel removed.

Top carrying cover 101 is capable of heavy lifting and yet is easily removed and stored on the body of device 100. Referring now to FIGS. 1 and 2 for steps for removing top carrying cover 101, it is preferred that six latches 110*a/b*, 110*c/d* (not shown), 112*a/b*, 113*a/b*, 111*a/b* and 111*c/d* be released. Further, in FIG. 2, an edge 127 of cover 101 is lifted up to expose opposing strips of hook and loop material 128 and 129 which run circumferentially around the top outside edge of top box 114 and on the inside surfaces of sides 103, 104, 105 and 147 to engage cover 101 to top box 114. These hook and loop material engagements are pulled apart by a user. Then, the top carrying cover 101 is rolled up starting with side 147, rolling up top 102 in a front direction and finally engaging hook and loop material from side 147 with hook and loop material 109 shown in FIG. 1. FIG. 3 shows top carrying cover 101 secured to the front 115 of top box 114 in a bunting style enhancing the podium look of device 100.

Referring again to FIG. 1, top box 114 comprises a front 115, a right side 116, a left side 117, and a bottom 118, whereby a fabric covered frame provides structural support for the box and a video display panel 119 located at about one half the height of front 115. Panel 119 is adapted to receive analog or digital input and provide information and entertainment displays to assist a presenter using device 100. The user would stand to the rear of device 100 while video and optionally audio played for an audience appreciation. Panel 119 can be located higher or lower than the position shown in FIGS. 1 and 2. Bracket 130 fixes panel 119 to an internal frame of top box 114 by way of screws, bolts, clamps or other means allowing a user to locate bracket 130 at a position higher or lower than that shown in FIGS. 1 and 2. With reference to FIGS. 1 and 2, carrier and loop sets 132*a* and 137*a* are situated about one half the elevation of the top and lower boxes so that when they are disconnected a user may easily lift each box by grasping the handles or loops on the sides of said box. These are not shown in the other drawing figures but are optionally included in the invention boxes.

FIG. 3 shows that top box 114 and lower box 121 respectively comprise openings 139*a*/139*b* and 139*c*/139*d* in their front fabric coverings. A vertical frame member 179 accessible through openings 139*a* and 139*c*. Section 179 extends up and down from openings 139*a* and 139*c* so that the video display panel can thereby be located at a higher or lower position, necessitating that openings 139*a* and 139*c* thereby be relocated to accommodate that change. Openings 139*b* and 139*d* are provided for passage of data or signal transmission and/or power cables from within said boxes to an externally viewable monitor mounted from section 179. Lower box 121 comprises an internal frame similar to that of top box 114 and further comprises a top 118*a*, a right side 123, a front 122, a left side 124 and a bottom 125. Repeating, top box 114 is releasably joined with lower box 121 by latches 119*a/b*, 119*c/d* (not shown), 120*a/b*, and 120*c/d*.

FIG. 3 shows that top box 114 can be lifted entirely free from lower box 121. Handle 138 is fixed to top 118*a* so that a user is capable of supporting from the hand of a user the entire weight of lower box 121 with up to or over 75 pounds of materials inside. Access to the interior of boxes 114 and 121 is by way of hinged doors at a rear side of device 100. FIG. 3 shows an important aspect of the invention in that sliding panels 144 are capable of being moved from a position within the downward cavity of cover 101 (as in FIG. 13) right and left to positions shown in FIG. 3. Two outer slide rails 10 are fixed to spacers 146 to elevate rails 10 above a front top frame member of top box 114 that is covered with front 115 materials. Similarly, another two outer slide rails 10 are fixed a rear top frame member of top box 114. The four outer slide rails allow their engaged inner slide rails 14 to slide into and out of the bodies of their outer slide rails. Fixed to an upper surface of the inner slide rails 14 are strips of hook and loop material 143 adapted to engage an opposing strip of hook and loop 143 material on an underside of sliding panels 144, thereby making sliding panels 144 movable in directions 145 and also easily removable by disengaging them from their hook and loop connection to the sliding means.

Figure 4:
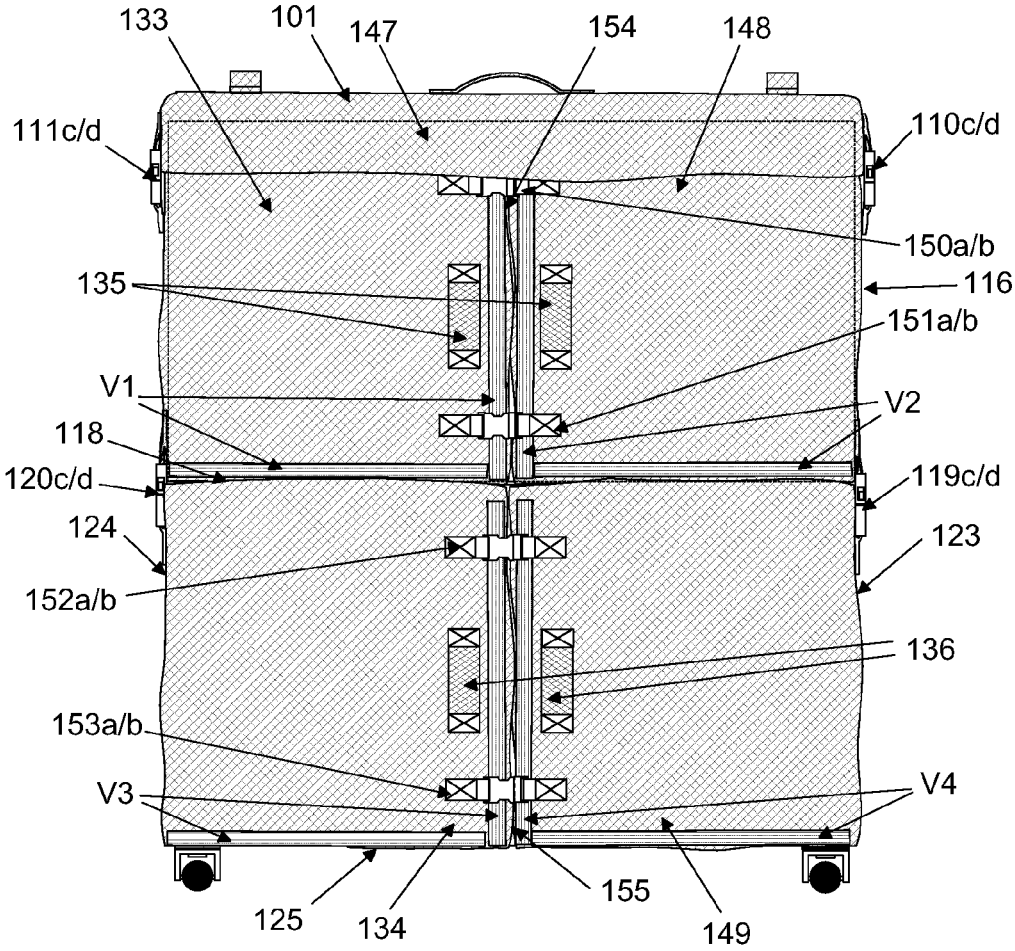
FIG. 4 is a rear view of the device of FIG. 1.

FIG. 4 shows a rear side of the invention device. Four hinged doors 133, 134, 148 and 149 provide access to interior storage and/or presentation space within boxes 114 and 121. Doors 133, 134, 148 and 149 are attached by sewn, flexible hinging attachment to rear edges of sides 115, 124, 116 and 123 respectively, thereby forming closed door interface edges 154 and 155. Said doors 133 and 148 are held closed by latches 150*a/b* and 151*a/b* and secure the contents of top box 114. Doors 134 and 149 and held closed by latches 152*a/b* and 153*a/b*. Handles 135 and 136 are grasped by a user to open said doors when the latches are released.

FIGS. 2 and 4 show a critical feature of the presentation device embodiment of the invention. Hook and loop strips V1 and V3 in FIG. 4 respectively engage hook and loop strips 132 and 137 in FIG. 2 when doors 133 and 134 are opened and pressed against sides 117 and 124. Similarly, hook and loop strips V2 and V4 engage opposing hook and loop strips located on sides 116 and 123 when doors 148 and 149 are opened and pressed to those sides. The inside surfaces of boxes 114 and 121 are adapted to support hook, shelves, pouches or similar means for presentation of items for use or viewing by a user or his audience. The fully opened doors 133, 134, 148 or 149 provide for a ready made vertical presentation surface all up and down sides 116, 117, 123 and 124, as will be described in FIG. 13.

Figure 5:
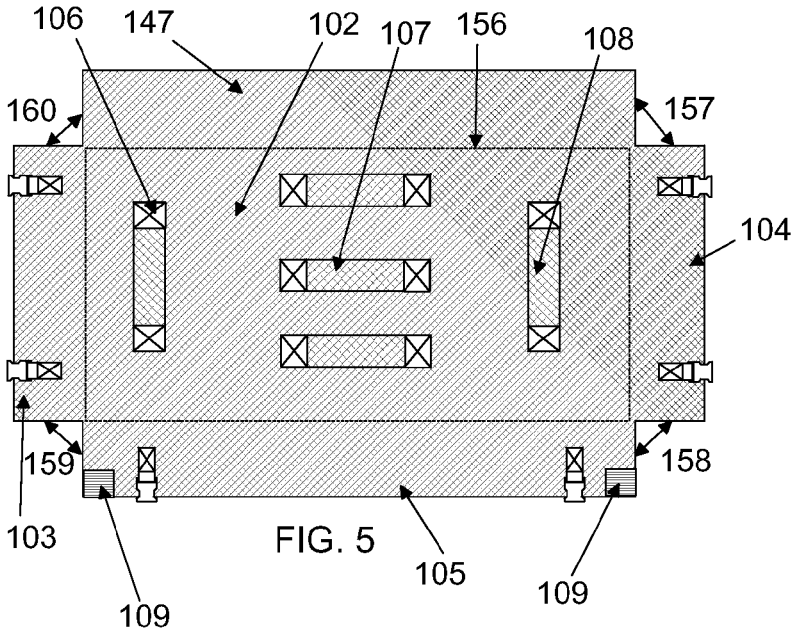
FIGS. 5 and 6 are respectively top and bottom views of the pre-sewing fabric of a top carrying cover as in FIG. 3.
Figure 6:
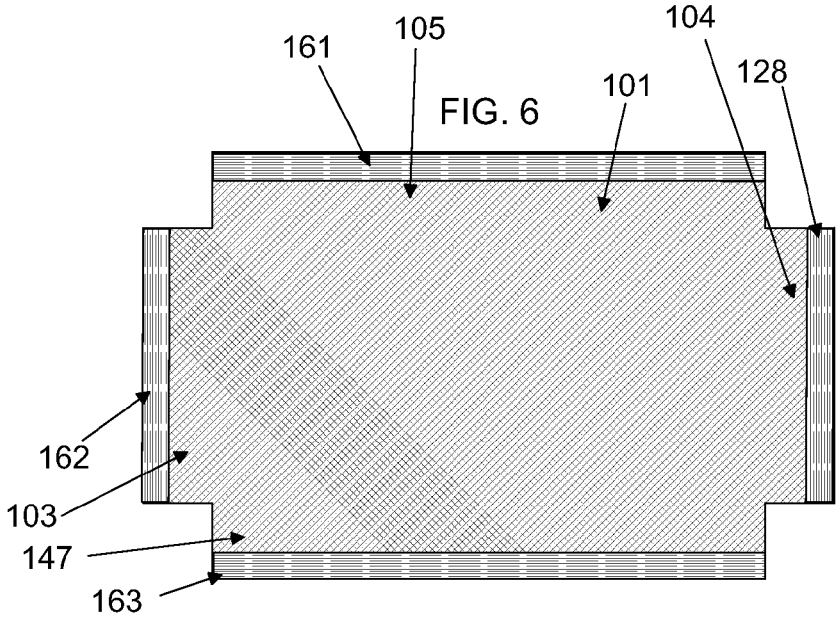

FIGS. 5 and 6 are respectively top and bottom views of the pre-sewing fabric of a top carrying cover 101, comprising the features described above. Edges 157 through 160 are sewn together to form the cover 101 as seen in FIG. 1. FIG. 6 shows hook and loop strips 128 and 161 through 163 which are adapted to engage opposing such strips about a top outside surface of top box 114. Frame outline 156 shows in broken lines the outer edges of a top part of a support frame for top box 114.

Figure 7:
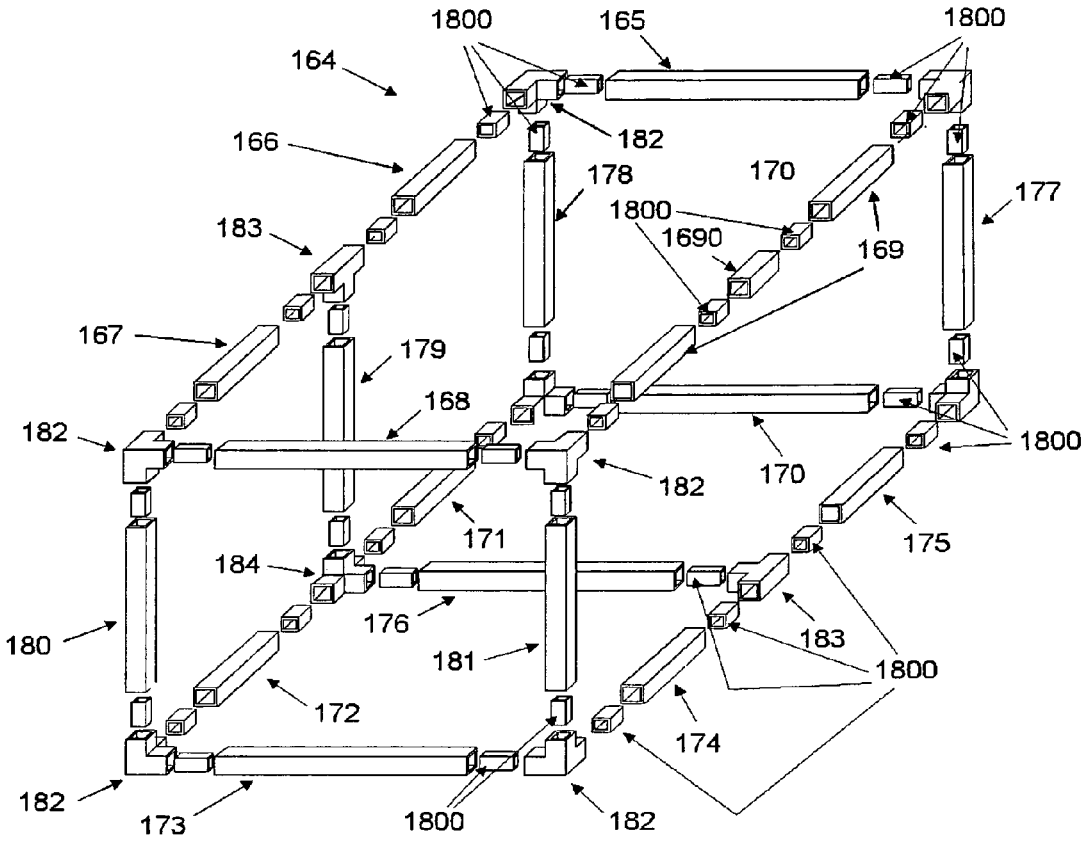
FIG. 7 is a perspective and exploded view of one embodiment of a frame for top and bottom boxes of the invention.

FIG. 7 is a perspective and exploded view of one embodiment of a frame 164 for top and bottom boxes of the invention. A top horizontal and rectangular portion comprises sections 165 through 169. A bottom horizontal and rectangular portion comprises sections 170 through 176. Vertical support is provided by sections 177 through 181. The frame sections are joined with eight three way junctions 182, two three way T-junctions 183, one four way junction 184, and one two way junction (for section 169) by way of smaller tube sections, defined as connectors (1800), which may be secured within one frame section or its junction. It is preferred that all frame sections will easily slide and disengage from their junctions shown so that the entire frame 164 can be disassembled and assembled with ease. Said smaller tube sections are preferably fixed at one end within their appropriate junction pieces as shown oriented in FIG. 7 to reduce the number of pieces to keep track of during storage, assembly and disassembly. The embodiment of FIG. 7 illustrates a section, shown comprising two shorter sections (169) joined by the two-way junction (1690), providing for a most compact disassembled volume of the invention boxes but said section could less preferably comprise a single long section. In addition, it is within the scope of the invention that frame 164 be formed of a top rectangle of sections 165 through 169 permanently fixed together, a bottom rectangle of sections 170 through 175, and vertical sections removably joining the top and bottom rectangles. It is further within the scope of the invention that frame 164 be formed of all the sections permanently fixed together.

Figure 8:
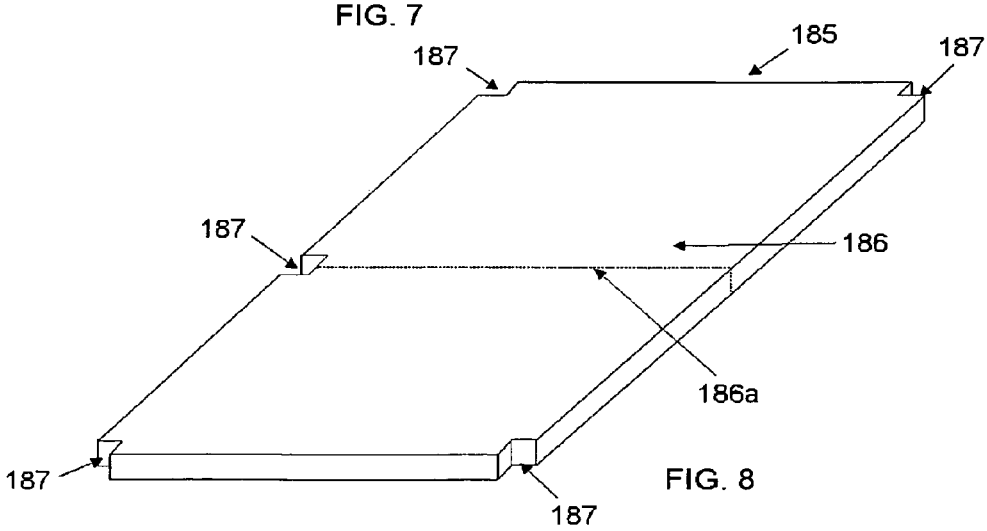
FIG. 8 is a perspective view of a top side of a floor plate adapted to be secured to a lower rectangle of the frame of FIG. 7.
Figure 9:
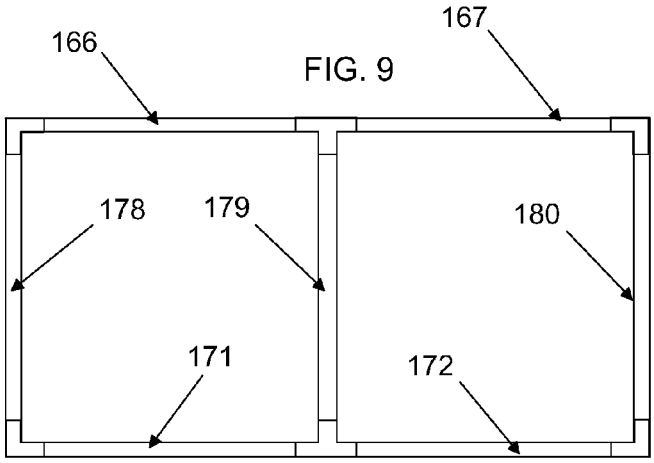
FIGS. 9, 10, 11, and 12 are respectively front, side, rear and top views of the frame of FIG. 7.
Figure 10:
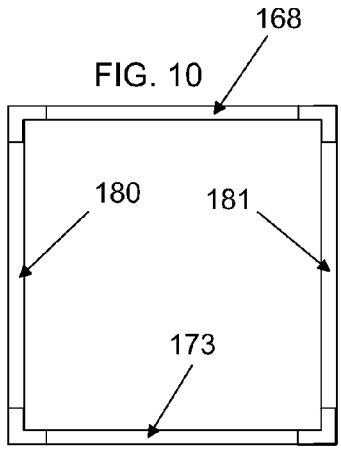
Figure 11:
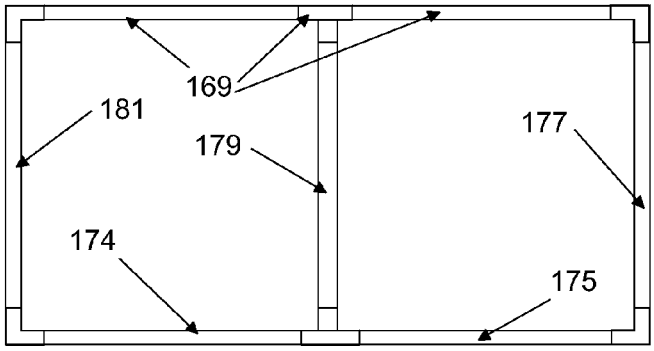
Figure 12:
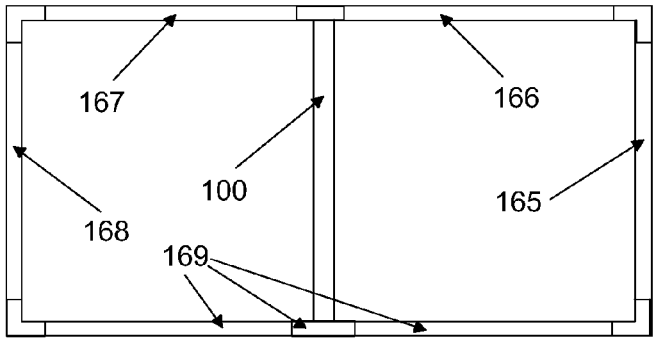

FIG. 8 is a perspective view of a top side of a floor plate 185 adapted to be placed upon and secured to some or all of frame sections 170 through 176 of FIG. 7. It is preferred that top surfaces of frame sections 170 through 176 bear hook and loop strips which will engage appropriately located hook and loop strips on an underside of floor plate 185 of FIG. 8. Floor plate 185 preferably comprises cutouts 187 to accommodate vertical frame members. Top surface 186 is adapted to support materials placed within the invention boxes, while fabric walls prevent they emission from said boxes. A preferred set of dimensions for the invention frame is width of about 28 inches, depth of about 15 inches, and height of about 17 inches. Floor plate 185 is presented with broken line 186*a* indicating that it can be formed in two (or more) pieces for more compact storage on disassembly while providing identical structural support for items to be located upon surface 186. As used herein, floor plate may refer to one or more pieces located upon a floor level of a top or lower box frame of the invention, whereupon a user then applies one of the fabric covers to the frame as shown and described below.

FIGS. 9, 10, 11, and 12 are respectively front, side, rear and top views of the frame of FIG. 7 and repeat the frame section numbers described above.

Figure 13:
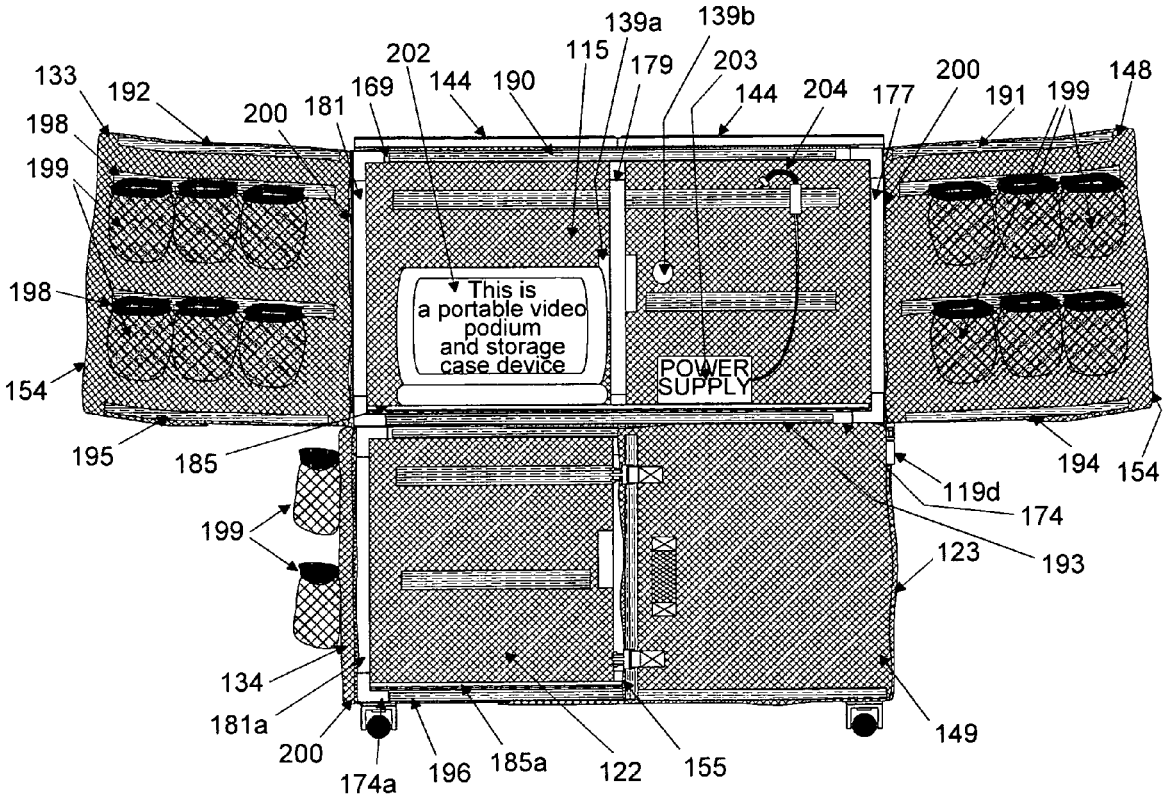
FIG. 13 is a rear side view of the device of FIG. 3 with one rear door open and secured to a left side of the box, two rear doors partly opened, and one rear door in a closed position.

FIG. 13 is a rear side view of the device 100 of FIG. 3 with one rear door 134 open and secured to a left side of a lower box 121, two rear doors 133 and 148 partly opened, and one rear door 149 in a closed position. Sliding panels 144 are shown in their non-extended positions so that a user can place materials on to top surfaces of panels 144 for use in presentations. Frame sections for top box 114 are shown with the same numbers used in FIG. 8 while frame sections for lower box 121 are shown with the same numbers followed by the letter "a". Frame members 169, 169*a*, 174/175 and 174*a*/175*a* respectively bear hook and loop strips 190, 193, 197 and 196 on rear facing surfaces. Hook and loop strip 190 engages hook and loop strips 192 and 191 and hook and loop strip 193 engages hook and loop strips 194 and 195 when doors 133 and 148 are in the closed position. Hook and loop strips 193 and 196 perform similarly for doors 134 and 149 in the closed positions. Floor plates 185 and 185*a* are shown in positions fixed respectively to frame members 174/175 and 174*a*/175*a* by opposing hook and loop strips. Sewn hinges 200 are shown for doors 133, 134 and 148. Doors 133 and 148 show hook and loop strips 198 for supporting therefrom baskets 199 for presentation of goods from vertical sides of the invention device, as for door 134. Other hook and loop strips are located about the interior fabric surfaces of boxes 114 and 121 for similar support of presentation materials. Power supply 203 is shown supported from floor plate 185 for powering such devices as the video display panel, a light 204 or a laptop computer 202, which is shown with a screen display identical to that shown in FIG. 1, whereby video and/or audio signals may be delivered to an audience by operation of such playback devices. A rear view of the invention device discloses a display case. A front view of the invention device discloses a podium.

Figure 14:
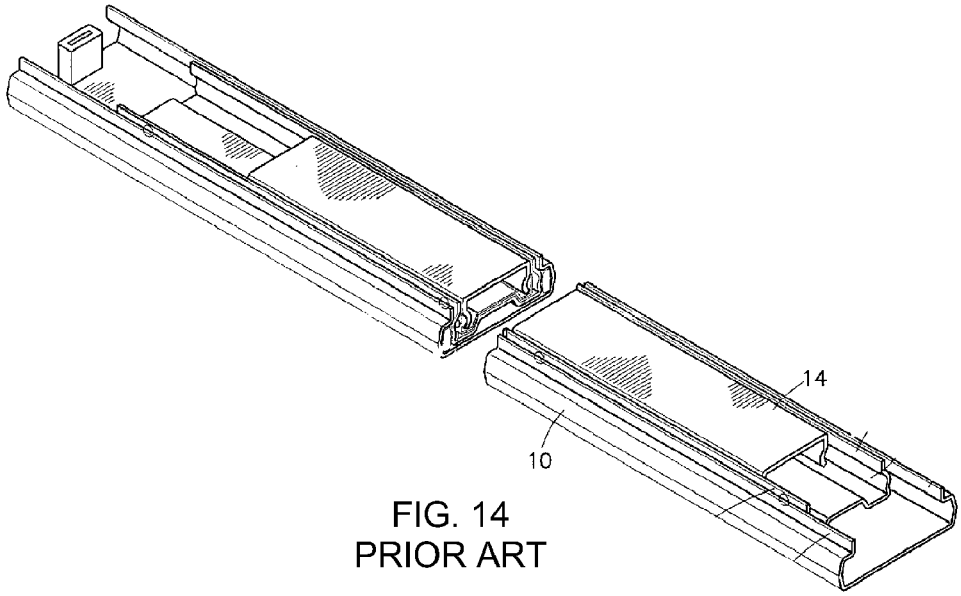
FIG. 14 PRIOR ART
FIG. 14 is a top view of a prior art slide means as disclosed in U.S. Pat. No. 6,378,968, which is incorporated herein by reference.
Figure 15:
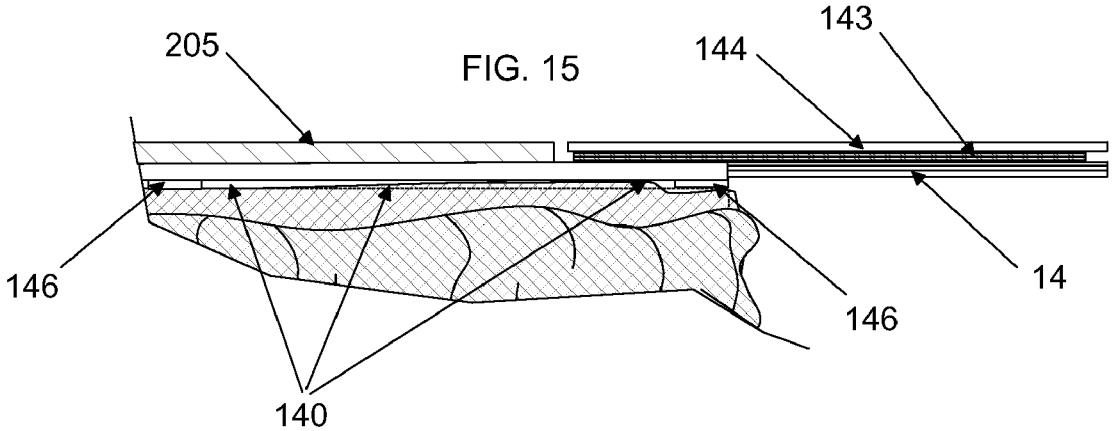
FIG. 15 is a magnified section of a left, upper side of the device of FIG. 3 showing sliding means, removable connection means and a slidable section to extend the top surface of the portable podium of the invention.
Figure 16:
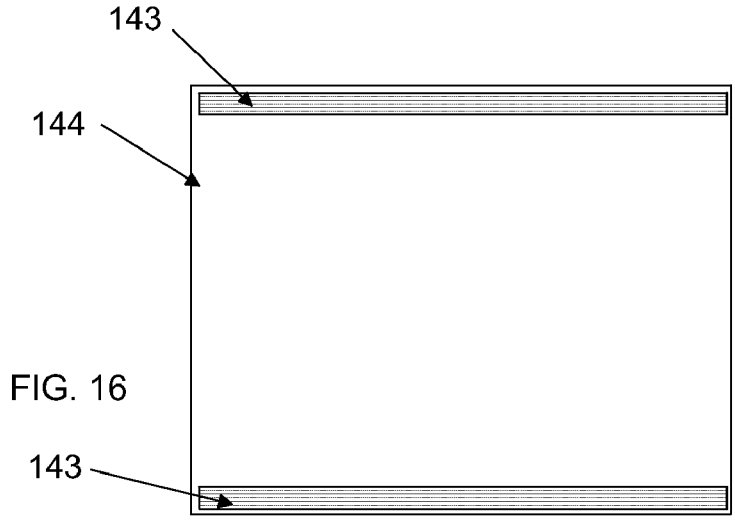
FIG. 16 is an underside of the slidable section of FIG. 15.

FIG. 14 is a top view of a prior art slide means as disclosed in U.S. Pat. No. 6,378,968, which is incorporated herein by reference. FIG. 15 is a magnified section of a left, upper side of the device of FIG. 3 showing sliding means, removable connection means 143 and other features as described above. A removable presentation plate 205 may be placed over an opening left by movement of the sliding panels 144 so that a continuous top surface is available to a presenter. FIG. 16 is an underside of the sliding panels 144 showing placement of hook and loop strips 143 as described above.

Figure 17:
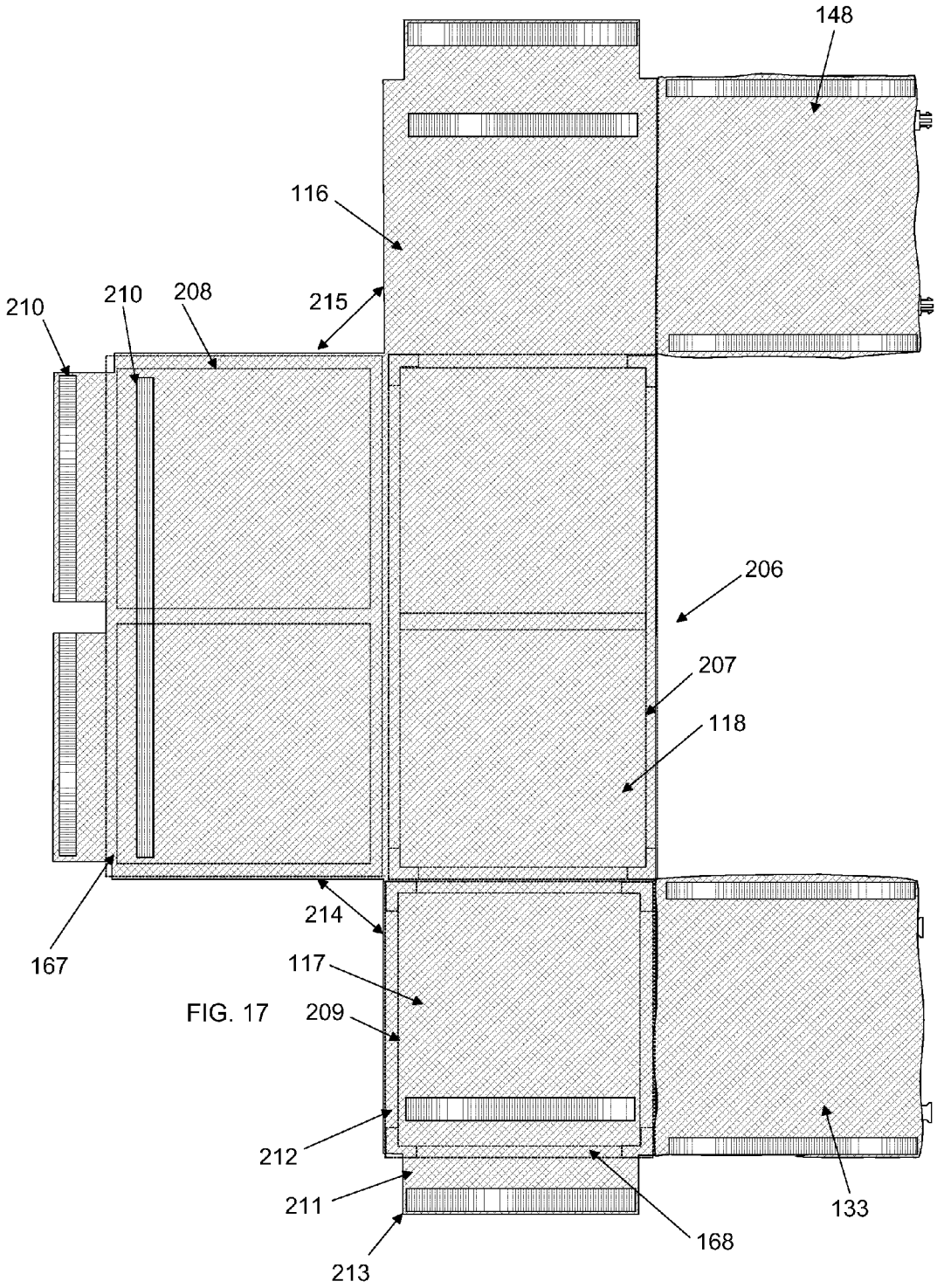
FIG. 17 is an inside view of the pre-sewing fabric of a fabric cover for the top box of FIG. 3.

FIG. 17 is an inside view of the pre-sewing fabric of a fabric cover 206 for the top box 114 of FIG. 3. Broken line outlines of sides of the frame in FIGS. 9 through 11. Frame 207 represents the frame view of FIG. 12. Frame 208 represents the frame view of FIG. 11. Frame 209 represents the frame view of FIG. 10. Sides 214 and 215 are intended to be sewn together. The panel numbers in FIG. 17 represent the fabric sides of the top box of the invention. Extension 211 is made from side 117 with hook and loop strips 212 and 213 in appropriate positions so that extension 211 can be wrapped around frame section 168. A similar extension with hook and loop strips is made for side 116. A similar extension 208 with hook and loop strips 210 is made for front 115 so that the extension can be wrapped around frame section 167. A cutout is provided so that the material fits through opening 140 of FIG. 15. Fabric cover 206 thereby is releasably secured to a frame for use as a top box of the invention.

Figure 18:
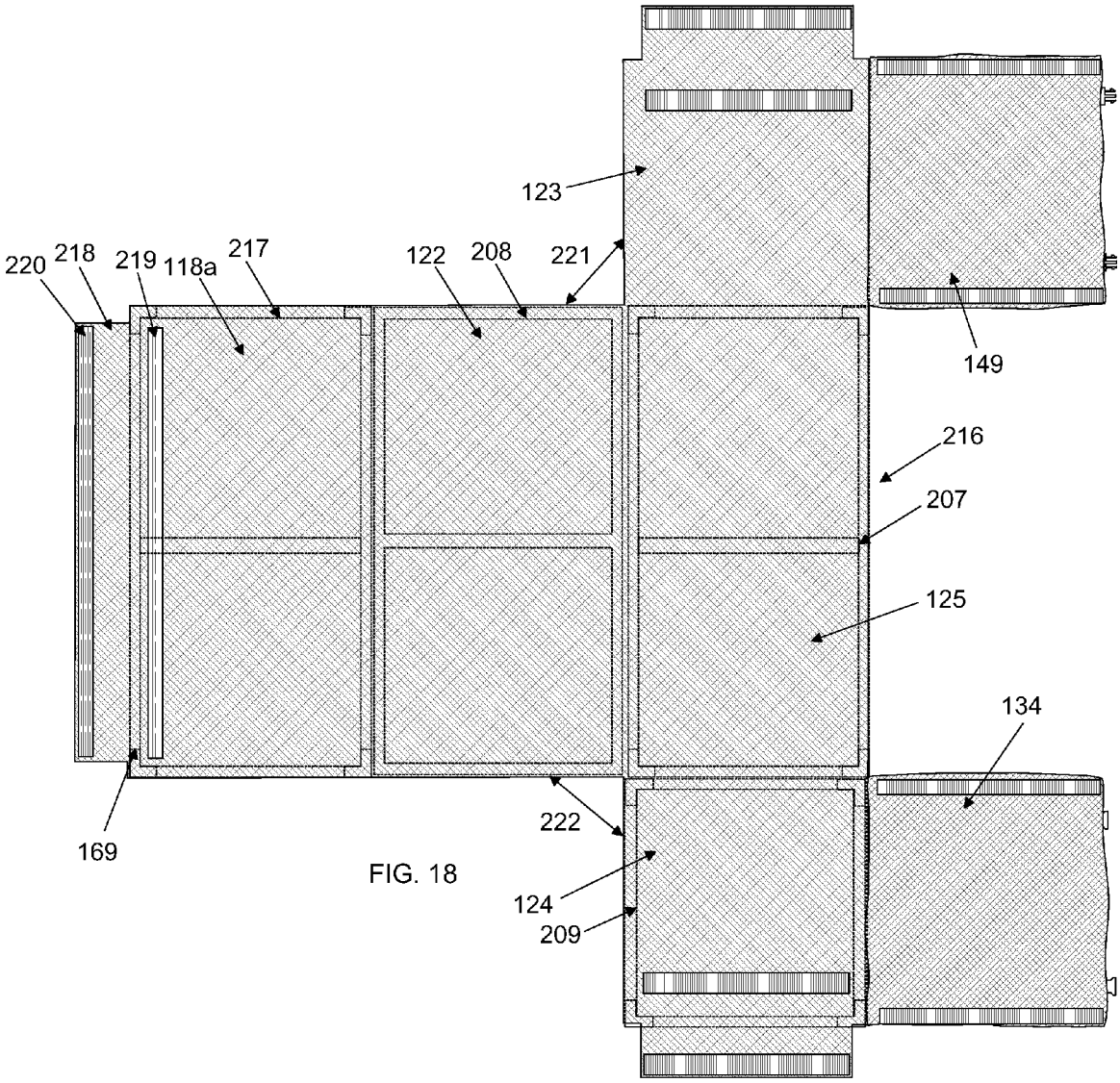
FIG. 18 is an inside view of the pre-sewing fabric of a fabric cover for the lower box of FIG. 3.

FIG. 18 is an inside view of the pre-sewing fabric of a fabric cover 216 for the lower box 121 of FIG. 3. Broken line outlines of sides of the frame in FIGS. 9 through 11. Frame 207 represents the frame view of FIG. 12. Frame 208 represents the frame view of FIG. 11. Frame 209 represents the frame view of FIG. 10. Frame 217 represents the frame view of FIG. 12. Sides 221 and 222 are intended to be sewn together. The panel numbers in FIG. 18 represent the fabric sides of the lower box of the invention. Cover 216 is identical to that of cover 206 of FIG. 17 except that it is extended by top 118*a* and extension 218 to have hook and loop strips 219 and 220 in appropriate positions so that extension 219 can be wrapped around frame section 169.

Figure 19:
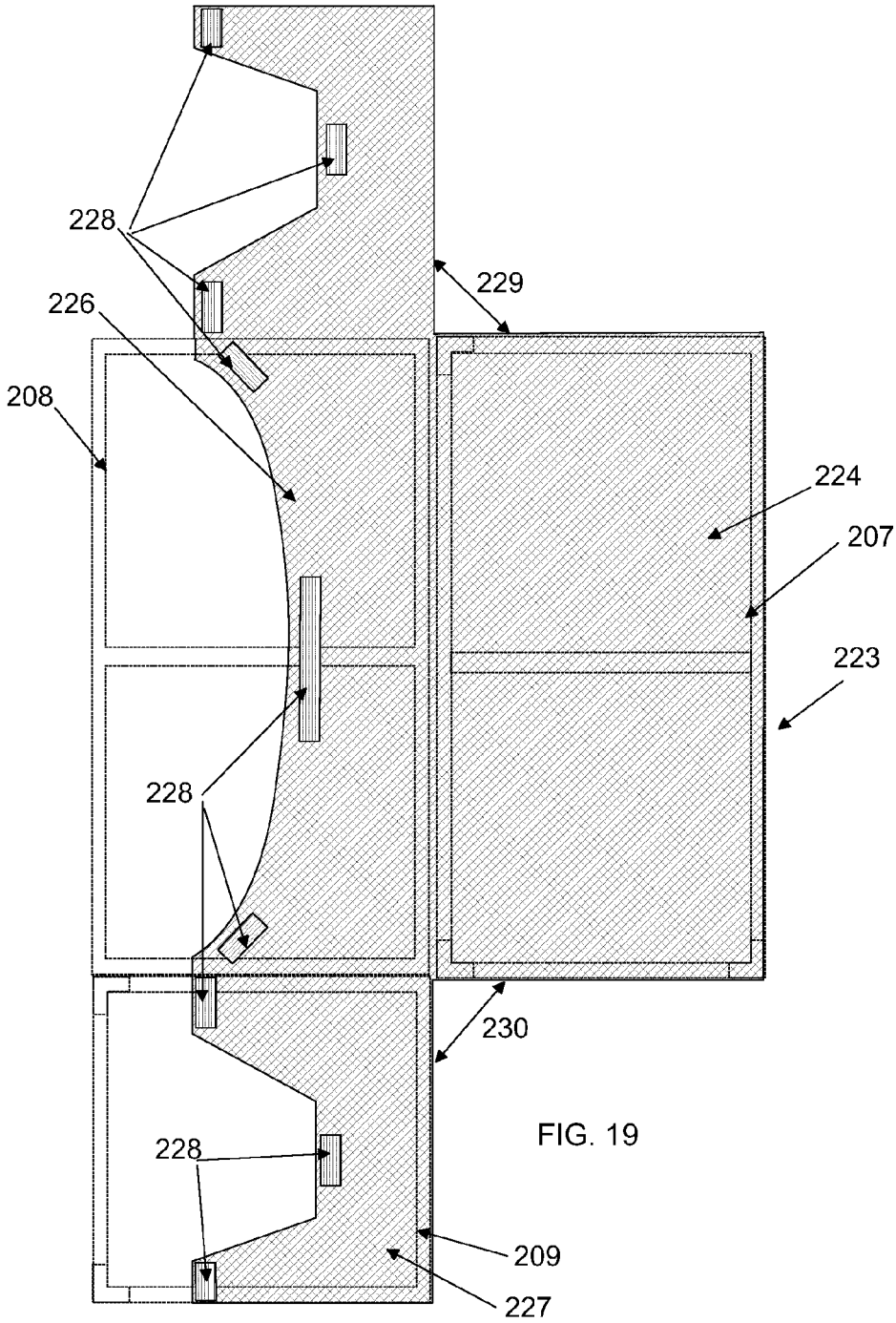
FIG. 19 is an inside view of the pre-sewing fabric of a fabric skirt cover for the lower box of FIG. 3.

FIG. 19 is an inside view of the pre-sewing fabric of a fabric skirt cover 223 for the lower box of FIG. 3. A bottom 224 is sewn to side panels 227 at edges 229 and 230, which extend from a central front panel 226. Hook and loop strips 228 are adapted to be applied to opposing strips on front 122 and sides 123 and 124 as in FIG. 3 to prevent abrasive wear of those fabric surfaces.

The above design options will sometimes present the skilled designer with considerable and wide ranges from which to choose appropriate apparatus and method modifications for the above examples. However, the objects of the present invention will still be obtained by that skilled designer applying such design options in an appropriate manner.

I claim:

1. A separable and portable podium (100) comprising:

(a) a top box (114) comprising a presentation surface means defined by two rigid horizontal sliding panels (144) separable in right and left directions relative to and slidingly connected on a top side (102) of the top box, and a first flexible and removable cover (206) covering a front side (115), a bottom side (118), a right side (116), and a left side (117) of the top box, the top box further defined by a top box internal frame (164), (b) a lower box (121) having no presentation surface means or other rigid surface means on a top side (118*a*) of the lower box and comprising a second flexible and removable cover (216) covering a front side (122), a bottom side (125), a right side (123), and a left side (124) of the lower box, the lower box further defined by a lower box internal frame (164);

wherein the top box internal frame and the lower box internal frame each consist entirely of:

(1) five vertical support bars (177-179), thirteen horizontal support bars (165-176), eight three-way corner junction pieces (182) for defining four vertical corners of the internal frame, two three-way T-junction pieces (183), a four-way junction piece (184), a two-way junction piece (1690), and thirty-five connectors (1800) for connecting each end of each said support bar to its designated junction piece; the left side of the internal frame is made up of a left-front of said vertical support bars (178), a left-rear of said vertical support bars (177), a left-top of said horizontal support bars (165), a left-bottom of said horizontal support bars (170), a left-front pair of said three-way corner junction pieces, a left-rear pair of said three-way corner junction pieces, and a left eight of said connectors connecting each support bar to their respective junction piece on the left side; the right side of the internal frame is made up of a right-front of said vertical support bars (180), a right-rear of said vertical support bars (181), a right-top of said horizontal support bars (168), a right-bottom of said horizontal support bars (173), a right-front pair of said three-way corner junction pieces, a right-rear pair of said three-way corner junction pieces, and a right eight of said connectors connecting each support bar to their respective junction piece on the right side; the front side of the internal frame is made up of one of said vertical support bars defining a center vertical support bar (179), a first of said three-way T-junction pieces (183) connected to a top end of said center vertical support bar, said four-way junction piece (184) connected to a bottom end of said center vertical support bar, a front-top pair of said horizontal support bars (166, 167) connected to said first three-way T-junction piece, a front-bottom pair of said horizontal support bars (171, 172) connected to said four-way junction piece, said front-top and front-bottom horizontal support bars connected to said right-front and left-front corner junction pieces, with a front ten of said connectors connecting each of said support bars to their respective junction piece on the front side; the rear side of the internal frame is made up of a rear-top pair of said horizontal support bars (169) connected to said two-way junction piece (1690) located centrally between said rear-top pair of said horizontal support bars, a rear-bottom pair of said horizontal support bars (174, 175) connected to a second of said three-way T-junction pieces (183) located centrally between said rear-bottom pair of said horizontal support bars, said rear-top and rear-bottom horizontal support bars connected to said right-rear and left-rear corner junction pieces, with a rear eight of said connectors connecting each of said support bars to their respective junction piece on the rear side; and the bottom side of the internal frame made up of one of said horizontal support bars defining a center horizontal support bar (176) connected by a bottom two of said connectors to said four-way junction piece (184) and said second three-way T-junction piece (183);

(2) a floor plate (185) releasably supported upon said horizontal support bars defining the bottom side of the internal frame;

(c) a releasable means for joining (119*a/b*, 119*c/d*, 120*a/b*, 120 *c/d*) the bottom side of the top box to the top side of the lower box, whereby the presentation surface is raised to a presentation level when the top box is joined to the lower box.

2. The podium of claim 1 wherein rear sides of the top and lower boxes comprise doors hinged at a vertex of the right or left side and the rear side and adapted to be fixed on an outside surface of the cover of the right or left side.

3. The podium of claim 2 wherein goods display means for supporting and presenting goods for viewing or purchase are mounted on an inside surface of said doors.

4. The podium of claim 3 whereby when said doors are in an open position a presentation device is formed from the rear side of the podium.

5. The podium of claim 1 wherein a video display panel is mounted to the front side of the top box and video playback means are connected with said video display panel for video playout thereon.

* * * * *